US011272792B2

(12) United States Patent
Saint et al.

(10) Patent No.: US 11,272,792 B2
(45) Date of Patent: Mar. 15, 2022

(54) INFANT PLAYPEN

(71) Applicant: Wonderland Switzerland AG, Steinhausen (CH)

(72) Inventors: Nathanael Saint, Morgantown, PA (US); Jennifer E. Sheldrick, Malvern, PA (US); Linda L. Forester, Pottstown, PA (US)

(73) Assignee: Wonderland Switzerland AG, Steinhausen (CH)

( * ) Notice: Subject to any disclaimer, the term of this patent is extended or adjusted under 35 U.S.C. 154(b) by 69 days.

(21) Appl. No.: 16/271,352

(22) Filed: Feb. 8, 2019

(65) Prior Publication Data

US 2019/0246812 A1 Aug. 15, 2019

Related U.S. Application Data

(60) Provisional application No. 62/629,281, filed on Feb. 12, 2018.

(51) Int. Cl.
*A47D 13/06* (2006.01)
*A47D 11/00* (2006.01)
(Continued)

(52) U.S. Cl.
CPC ..... *A47D 13/063* (2013.01); *A47D 7/002* (2013.01); *A47D 7/005* (2013.01); *A47D 11/007* (2013.01); *A47D 13/00* (2013.01); *A47D 13/066* (2013.01)

(58) Field of Classification Search
CPC .... A47D 13/063; A47D 13/066; A47D 7/005; A47D 7/00; A47D 7/002; A47D 11/007;
(Continued)

(56) References Cited

U.S. PATENT DOCUMENTS 4,985,984 A 1/1991 Umezaki
5,727,265 A 3/1998 Ziegler et al.
(Continued)

FOREIGN PATENT DOCUMENTS

AU 2011218656 A1 3/2012
EP 295761 A2 12/1988
(Continued)

OTHER PUBLICATIONS

Combined Search and Examination Report of the corresponding UK Patent Application No. 1901685.6 dated Jun. 28, 2019.
(Continued)

*Primary Examiner* — David R Hare
*Assistant Examiner* — Madison Emanski
(74) *Attorney, Agent, or Firm* — NZ Carr Law Office PLLC

(57) ABSTRACT

An infant playpen includes a support frame including a pivot connection, and an enclosure installable on the support frame, the enclosure comprising a flexible material including an expandable portion having multiple folds, the expandable portion covering the pivot connection when the enclosure is installed on the support frame. In some embodiments, the enclosure may have a sidewall including an inner layer and an outer layer, the support frame extending through a hollow interior between the inner layer and the outer layer when the enclosure is installed on the support frame.

18 Claims, 8 Drawing Sheets

(51) Int. Cl.
*A47D 13/00* (2006.01)
*A47D 7/00* (2006.01)

(58) Field of Classification Search
CPC ..... A47D 13/00; A47D 13/06; A47C 21/08; A47C 19/04
See application file for complete search history.

(56) References Cited

U.S. PATENT DOCUMENTS

| | | | | |
|---|---|---|---|---|
| 6,421,850 | B1 | 7/2002 | Welsh, Jr. | |
| 9,149,128 | B2 * | 10/2015 | Rampton | A47D 13/063 |
| 9,848,714 | B2 * | 12/2017 | Burns | A47D 13/06 |
| 10,477,981 | B2 * | 11/2019 | Burns | A47D 1/008 |
| 10,492,623 | B2 * | 12/2019 | Troutman | A47D 13/063 |
| 2002/0152550 | A1 * | 10/2002 | Tharalson | A47D 5/00 5/95 |
| 2007/0214576 | A1 * | 9/2007 | Espenshade | A47D 15/003 5/723 |
| 2008/0189854 | A1 | 8/2008 | Thorne et al. | |
| 2012/0012801 | A1 | 1/2012 | Burns et al. | |
| 2016/0000234 | A1 | 1/2016 | Whitman | |

FOREIGN PATENT DOCUMENTS

| | | | |
|---|---|---|---|
| GB | 2553886 | A | 3/2018 |
| WO | 2016/130361 | A1 | 8/2016 |

OTHER PUBLICATIONS

Combined Search and Examination Report of the corresponding UK Patent Application No. 2009553.5 dated Jul. 14, 2020.

* cited by examiner

INFANT PLAYPEN

CROSS-REFERENCE TO RELATED APPLICATION(S)

This application claims priority to U.S. Provisional Application No. 62/629,281 filed on Feb. 12, 2018, the disclosure of which is incorporated herein by reference.

BACKGROUND

1. Field

The present disclosure relates to infant playpens.

2. Description of the Related Art

An infant playpen can typically receive a child in a safe and comfortable environment. Many existing infant playpens are designed with a frame structure that allows folding into a compact form for convenient transport or storage. However, the conventional folding structures may be complex, which makes it difficult for a caregiver to fold and unfold the infant playpens. In particular, folding and unfolding infant playpens can be difficult for caregivers who are physically inhibited in a way that reduces their strength and coordination.

Another common problem with current infant playpens relates to the difficulty in removing the flexible enclosure from the frame structure. A child occupant of the infant playpen may have a tendency to produce stains on the enclosure. When the enclosure is difficult to remove, a caregiver may not be able to easily wash the stains away.

Therefore, there is a need for an improved design to provide an infant playpen that is more convenient in use and to address at least the foregoing issues.

SUMMARY

The present disclosure describes an infant playpen that can be folded and unfolded effortlessly and has a construction allowing easy removal of an enclosure from a support frame. In one embodiment, for example, the infant playpen includes a support frame including a pivot connection, and an enclosure installable on the support frame, the enclosure comprising a flexible material including an expandable portion having multiple folds, where the expandable portion covers the pivot connection when the enclosure is installed on the support frame.

In another embodiment, a infant playpen provided herein includes a support frame, and an enclosure installable on the support frame and comprising a flexible material, the enclosure having a sidewall including an inner layer and an outer layer, where the support frame extends through a hollow interior between the inner layer and the outer layer when the enclosure is installed on the support frame.

DETAILED DESCRIPTION OF THE EMBODIMENTS

Figure 1:
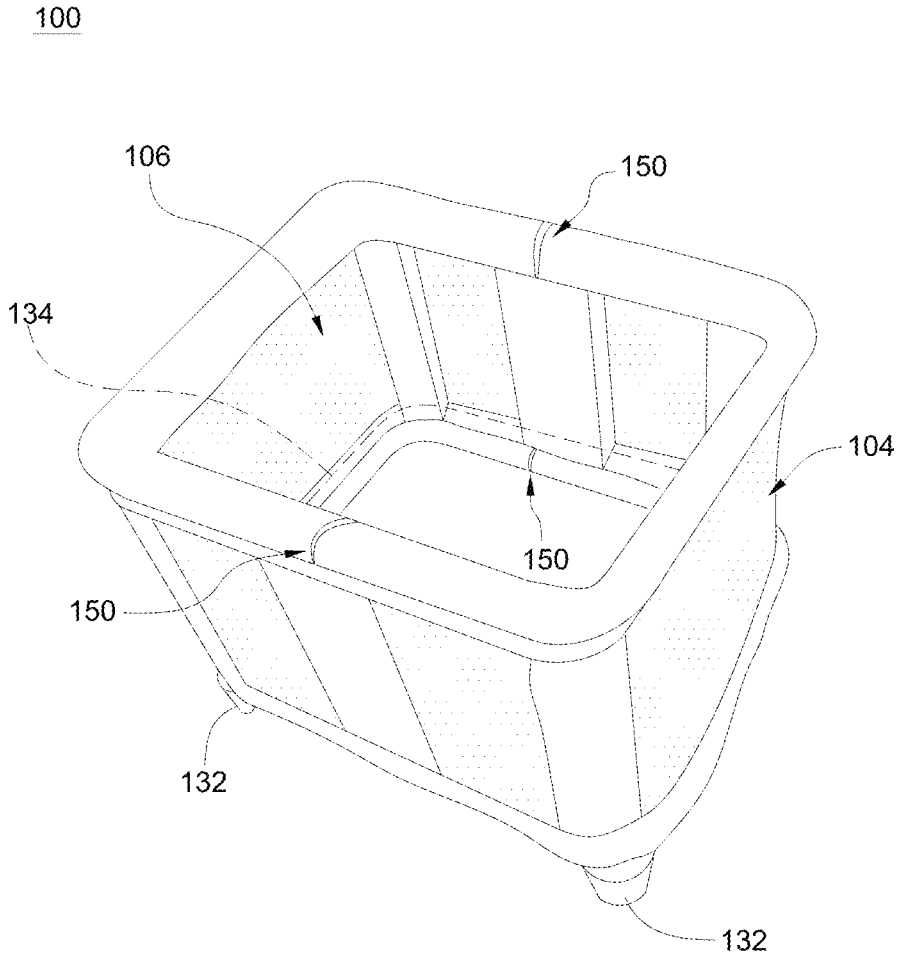
FIG. 1 is a perspective view illustrating an infant playpen in an unfolded state, according to an embodiment disclosed herein.
Figure 2:
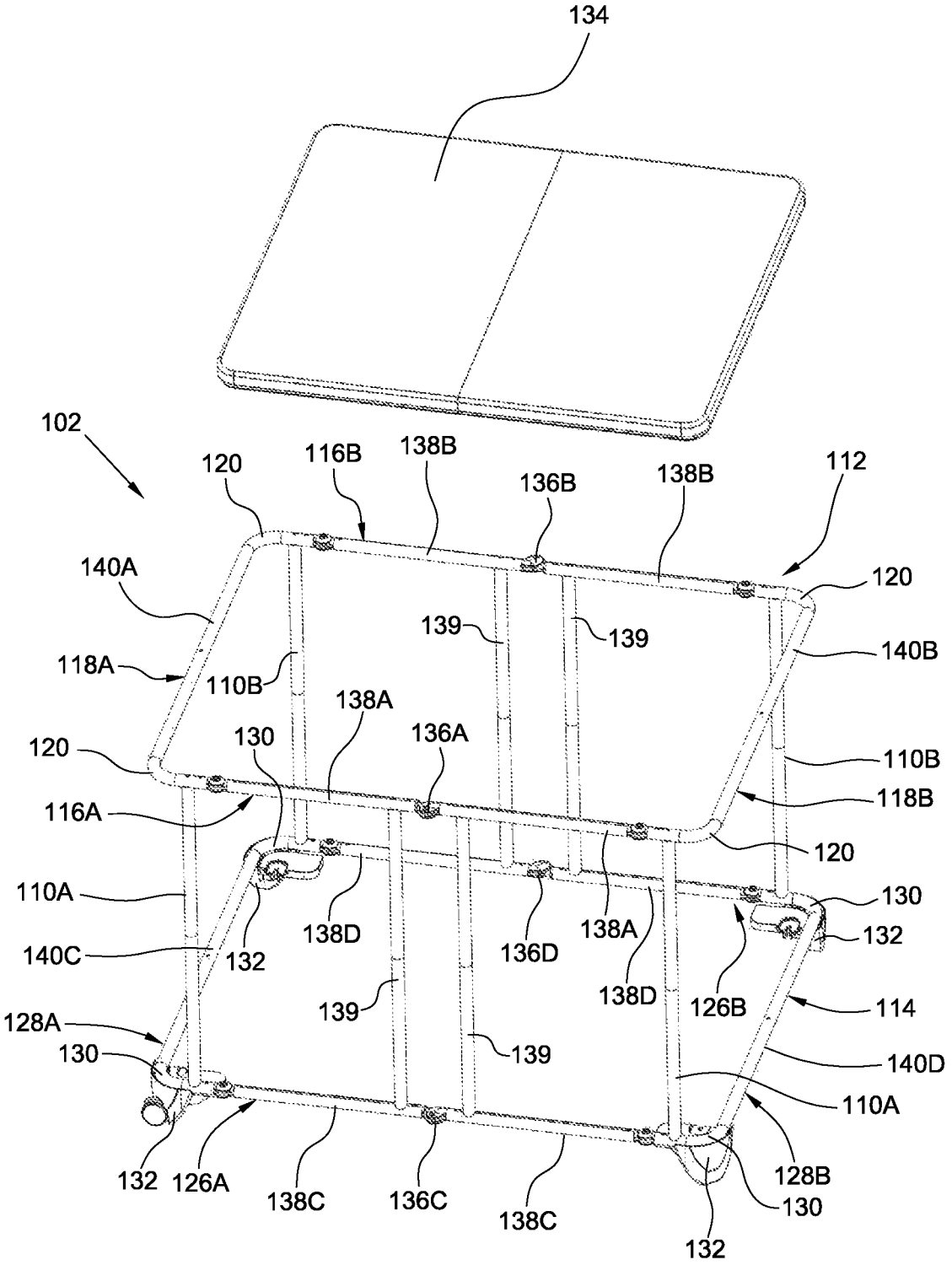
FIG. 2 is a perspective view illustrating a rigid support frame of the infant playpen shown in FIG. 1, according to an embodiment disclosed herein.
Figure 3:
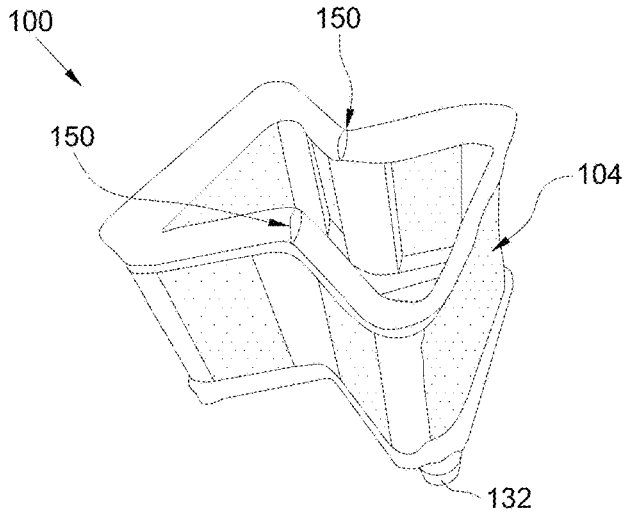
FIGS. 3-5 are perspective views illustrating an exemplary folding operation of the infant playpen shown in FIG. 1, according to an embodiment disclosed herein.
Figure 4:
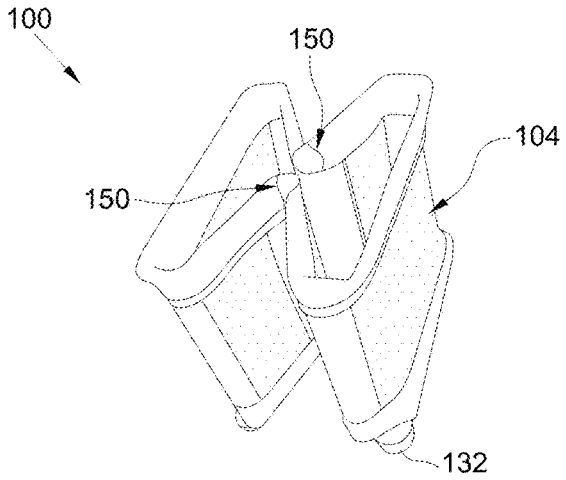
Figure 5:
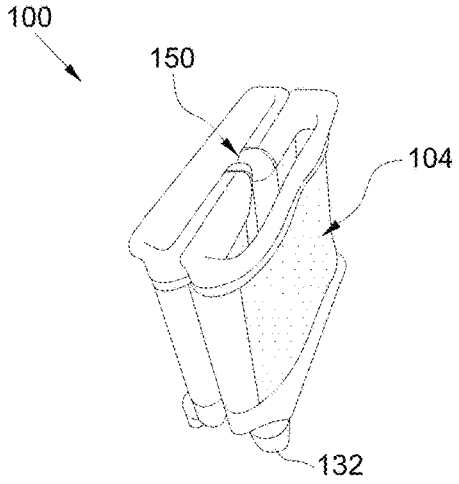

FIG. 1 is a perspective view illustrating an embodiment of an infant playpen 100 in an unfolded state, and FIG. 2 is a perspective view illustrating a rigid support frame 102 of the infant playpen 100. Referring to FIGS. 1 and 2, the infant playpen 100 can include a rigid support frame 102 formed by the assembly of multiple tube segments, and an enclosure 104 that can be installed on the support frame 102 and surround an interior 106 of the infant playpen 100. The support frame 102 can include a plurality of upright legs 110A and 110B, a top frame portion 112 and a bottom frame portion 114.

According to an example of construction, the top frame portion 112 includes two side rail assemblies 116A and 116B opposite to each other and extending substantially parallel to each other along a first direction, and two other side rail assemblies 118A and 118B opposite to each other and extending substantially parallel to each other along a second direction perpendicular to the first direction. The side rail assemblies 118A and 118B can be respectively connected with the side rail assemblies 116A and 116B via a plurality of top corner parts 120.

The bottom frame portion 114 is disposed below the top frame portion 112. According to an example of construction, the bottom frame portion 114 includes two side rail assemblies 126A and 126B opposite to each other and extending substantially parallel to each other along the first direction, and two other side rail assemblies 128A and 128B opposite to each other and extending substantially parallel to each other along the second direction perpendicular to the first direction. In particular, the two side rail assemblies 126A and 126B of the bottom frame portion 114 can be substantially parallel to the two side rail assemblies 116A and 116B of the top frame portion 112, respectively. The two side rail assemblies 128A and 128B of the bottom frame portion 114 can be substantially parallel to the two side rail assemblies 118A and 118B of the top frame portion 112, respectively. Moreover, the side rail assemblies 128A and 128B can be respectively connected with the side rail assemblies 126A and 126B via a plurality of bottom corner parts 130.

The four upright legs 110A and 110B can provide support for the top frame portion 112. For example, each of the upright legs 110A and 110B may be formed by an upright tubular segment that has an upper end affixed to one top corner joint 120 and a lower end affixed to one bottom corner part 130. According to an example of construction, each bottom corner part 130 is fixedly connected with a foot portion 132 protruding downward. The foot portions 132 can provide stable standing support for the infant playpen 100 on a floor surface.

Referring to FIGS. 1 and 2, a mattress 134 (shown with phantom lines in FIG. 2) may be disposed at a bottom of the infant playpen 100. According to an example of construction, the mattress 134 is peripherally supported by the bottom frame portion 114 of the support frame 102 without the need for a bottom panel under the mattress 134. For example, multiple brackets may be respectively provided at the corners of the bottom frame portion 114 for supporting the mattress 134. This may allow simple assembly and disassembly of the infant playpen 100, and reduce the manufacturing cost. The mattress 134 may be removed when the infant playpen 100 is to be folded.

Referring to FIG. 2, the support frame 102 can include a plurality of pivot connections for folding and unfolding of the infant playpen 100. For example, a middle of the side rail assembly 116A can have a pivot connection 136A that couples two bars 138A of the side rail assembly 116A. A middle of the side rail assembly 116B can have a pivot connection 136B that couples two bars 138B of the side rail assembly 116B. A middle of the side rail assembly 126A can have a pivot connection 136C that couples two bars 138C of the side rail assembly 126A. A middle of the side rail assembly 126B can have a pivot connection 136D that couples two bars 138D of the side rail assembly 126B. Moreover, each of the bars 138A and 138B can be respectively connected pivotally with one top corner part 120, and each of the bars 138C and 138D can be respectively connected pivotally with one bottom corner part 130. A plurality of upright bars 139 may be respectively connected between the side rail assemblies 116A and 126A and between the side rail assemblies 116B and 126B for providing further support stability.

Referring to FIG. 2, the side rail assembly 118A of the top frame portion 112 can include a continuous bar 140A having no middle pivot connection, and the side rail assembly 118B of the top frame portion 112 can have a continuous bar 140B having no middle pivot connection. Each of the bars 140A and 140B can be respectively connected fixedly with two top corner parts 120 at two opposite ends. Likewise, the side rail assembly 128A of the bottom frame portion 114 can include a continuous bar 140C having no middle pivot connection, and the side rail assembly 128B of the bottom frame portion 114 can have a continuous bar 140D having no middle pivot connection. Each of the bars 140C and 140D can be respectively connected fixedly with two bottom corner parts 130 at two opposite ends.

In conjunction with FIGS. 1 and 2, FIGS. 3-5 are perspective views illustrating an exemplary folding operation of the infant playpen 100. Referring to FIGS. 1-5, the infant playpen 100 can be collapsed by folding the two side rail assemblies 116A and 116B of the top frame portion 112 about the pivot connections 136A and 136B and by folding the two side rail assemblies 126A and 126B of the bottom frame portion 114 about the pivot connections 136C and 136D, whereby the side rail assemblies 118A and 128A can respectively move toward the side rail assemblies 118B and 128B.

Referring to FIG. 1-5, the enclosure 104 can be made of a flexible material. Examples of suitable materials for the enclosure 104 include, without limitation, fabrics, mesh materials and like soft goods. The enclosure 104 may be installed on the support frame 102 so as to surround the interior 106 of the infant playpen 100 where a child can be received. Once the enclosure 104 is installed on the support frame 102, the enclosure 104 can wrap around the top frame portion 112 and stretch downward to the bottom frame portion 114. For facilitating folding of the infant playpen 100, the enclosure 104 can include a plurality of expandable portions 150. When the enclosure 104 is installed on the support frame 102, the expandable portions 150 can respectively cover the pivot connections 136A, 136B, 136C and 136D.

Figure 6:
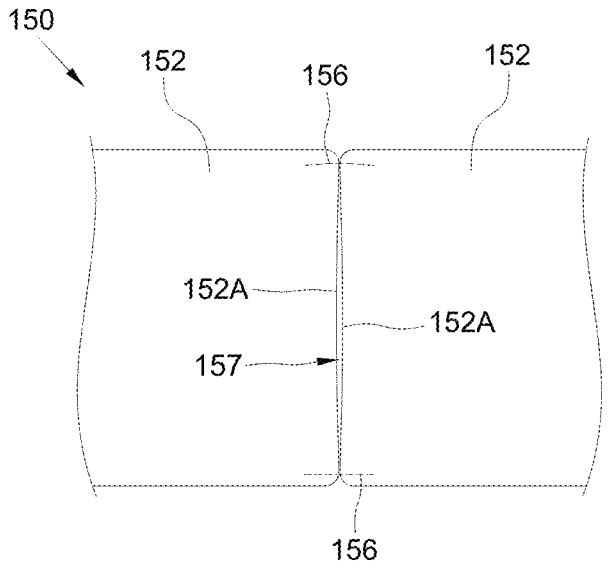
FIG. 6 is an enlarged planar view of an expandable portion provided on an enclosure of the infant playpen, according to an embodiment disclosed herein.
Figure 7:
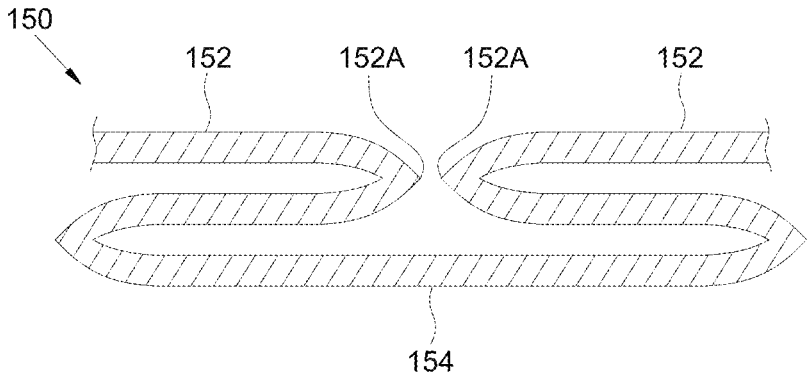
FIG. 7 is a cross-sectional view of the expandable portion shown in FIG. 6, according to an embodiment disclosed herein.

All the expandable portions 150 of the enclosure 104 can have a similar structure. In conjunction with FIGS. 1-5, FIG. 6 is an enlarged planar view of one expandable portion 150, and FIG. 7 is a cross-sectional view of the expandable portion 150. Referring to FIGS. 6 and 7, the expandable portion 150 can be made of a flexible material, and can include multiple folds 152. Examples of suitable materials for the expandable portion 150 include, without limitation, fabrics. When the enclosure 104 is installed on the support frame 102, the folds 152 can wrap around a pivot connection (e.g., any one of the pivot connections 136A, 136B, 136C and 136D) that is covered by the expandable portion 150. According to an example of construction, the expandable portion 150 includes two folds 152 respectively having two folded edge portions 152A that are movable toward and away from each other for contraction and expansion of the expandable portion 150.

Figure 8:
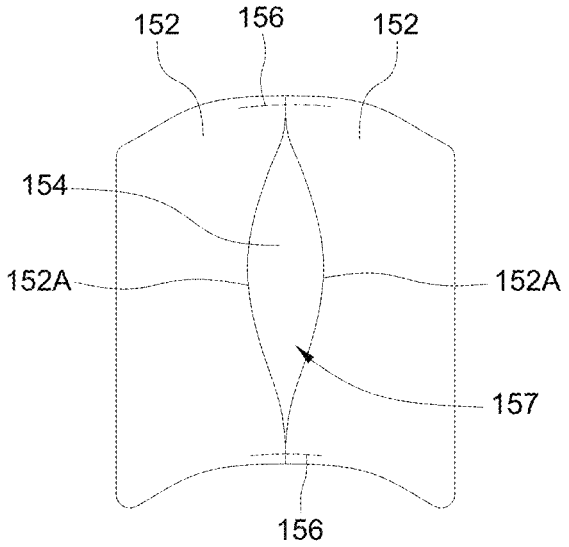
FIG. 8 is a schematic view illustrating the expandable portion in an expanded state, according to an embodiment disclosed herein.

According to an embodiment, the expandable portion 150 includes an inverted box pleat. The inverted box pleat may be formed by folding the two folds 152 folded toward one another over a base region 154 of the enclosure fabric so that the two folded edge portions 152A of the two folds 152 are substantially adjacent to each other. Two sewing lines 156 then may be respectively applied at two opposite ends of each folded edge portion 152A to hold the inverted box pleat. The two folded edge portions 152A and the two sewing lines 156 can thereby define an opening 157 that is delimited at least partially by the two folded edge portions 152A above the base region 154, the opening 157 narrowing when the expandable portion 150 is unfolded, as illustrated in FIG. 6. When the expandable portion 150 is folded, the opening 157 can enlarge, as illustrated in FIG. 8.

Figure 9:
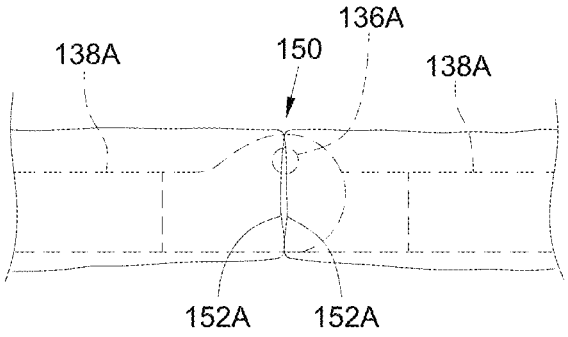
FIG. 9 is an enlarged view illustrating the expandable portion of the enclosure associated with one pivot connection of the infant playpen in an unfolded state, according to an embodiment disclosed herein.
Figure 10:
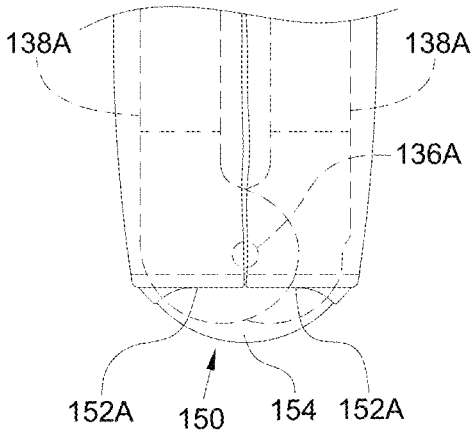
FIG. 10 is an enlarged view illustrating the expandable portion when the infant playpen is in a folded state, according to an embodiment disclosed herein.

In conjunction with FIGS. 1 and 2, FIG. 9 is an enlarged view illustrating the expandable portion 150 of the enclosure 104 associated with the pivot connection 136A of the infant playpen 100 in an unfolded state, and FIG. 10 is an enlarged view illustrating the expandable portion 150 when the infant playpen 100 is in a folded state. Referring to FIG. 9, when the pivot connection 136A is in the unfolded state with the two bars 138A extending generally along a same line, the expandable portion 150 of the enclosure 104 can appear relatively flat with the two folded edge portions 152A adjacent to each other. Referring to FIG. 10, when the pivot connection 136A is in the fully folded state with the two bars 138A adjacent and parallel to each other, the two folded edge portions 152A stretch away from each other so that the base region 154 is exposed. It will be readily appreciated that the expandable portions 150 associated with the other pivot connections 136B, 136C and 136D can be configured and operate in a similar way.

The expandable portions 150 of the enclosure 104 described herein do not affect the overall outer appearance when the infant playpen 100 is unfolded for use, and allow full folding of the infant playpen 100 without requiring the user to exert much effort or precise coordination. Moreover, when the infant playpen 100 is fully folded, the enclosure 104 can substantially enclose the pivot connections 136A and 136B so that a child would not be able to directly touch or hit the rigid structure of the pivot connections, which may prevent undesirable accidents. This can provide a significant improvement over conventional infant playpens that usually do not enclose the pivot connections with the enclosure fabric so as not to impede the ability of the infant playpens to fold into a small size.

In conjunction with FIGS. 1 and 2, FIGS. 11 and 12 are two perspective views illustrating another construction feature that may be applied in the infant playpen 100. Referring to FIGS. 1, 2, 11 and 12, the enclosure 104 may include an inner layer 160 and an outer layer 162 connected with each other. The inner layer 160 and the outer layer 162 can delimit a hollow interior of the enclosure 104 in which the four upright legs 110A and 110B, the top frame portion 112 and the bottom frame portion 114 can be received. Examples of flexible materials for the inner layer 160 and the outer layer 162 include, without limitations, fabrics, mesh materials and like soft goods. When the enclosure 104 is installed on the support frame 102, the support frame 102 can extend through the hollow interior between the inner layer 160 and the outer layer 162, whereby the inner layer 160 and the outer layer 162 can substantially enclose the four upright legs 110A and 110B, the top frame portion 112 and the bottom frame portion 114. Once the enclosure 104 is installed, the inner layer 160 faces the interior 106 of the infant playpen 100, the outer layer 162 faces outward, and the foot portions 132 can protrude outward from corresponding foot holes provided in the enclosure 104. Each of the sidewalls of the enclosure 104 stretching between the upright legs 110A and 110B can thus include the inner layer 160 and the outer layer 162. With this dual-layer sidewall structure, the enclosure 104 may be more durable. Moreover, the inner layer 160 and the outer layer 162 may have different design patterns and/or colors as desired.

Figure 11:
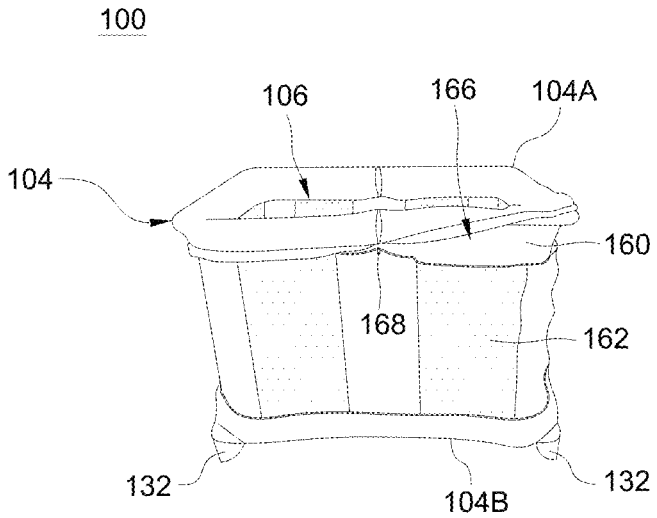
FIGS. 11 and 12 are perspective views illustrating a further construction feature that may be applied in an infant playpen, according to an embodiment disclosed herein.
Figure 12:
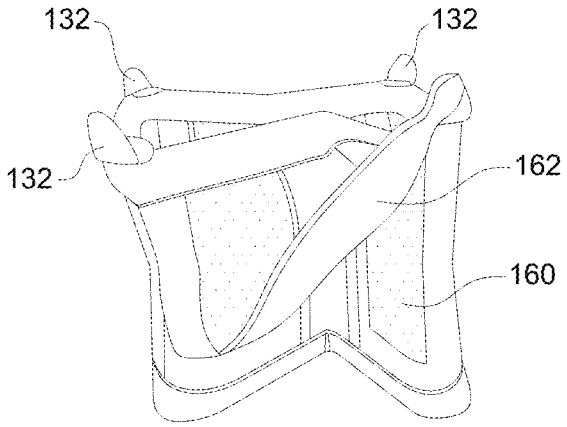

Referring to FIGS. 11 and 12, the enclosure 104 can include an opening 166 communicating with the hollow interior between the inner layer 160 and the outer layer 162. The enclosure 104 can be opened at the opening 166 for installation and removal of the enclosure 104 with respect to the support frame 102, and the opening 166 can be closed after the enclosure 104 is installed over the support frame 102 for holding a portion of the support frame 102 inside the hollow interior between the inner layer 160 and the outer layer 162 of the enclosure 104. The size of the opening 166 is sufficiently large for installation and removal of the enclosure 104 on the support frame 102. For example, the opening 166 may extend along at least one side of the enclosure 104. According to an embodiment, the opening 166 extends circumferentially around the enclosure 104. For example, the opening 166 may be placed adjacent to the outer layer 162, as shown in FIG. 11. According to an example of construction, the opening 166 is disposed closer to a top 104A of the enclosure 104 than a bottom 104B of the enclosure 104. It will be appreciated, however, that other positions of the opening 166 are possible. Moreover, the enclosure 104 can include a fastener 168 operable to open and close the opening 166. According to an example of construction, the fastener 168 is a zip fastener.

The aforementioned construction may allow easy installation and removal of the enclosure 104. A caregiver can operate the fastener 168 to open the enclosure 104, as illustrated in FIG. 11. Then the infant playpen 100 may be flipped so that the foot portions 132 are on top, and the outer layer 162 may be lifted for removing the enclosure 104 from the support frame 102, as illustrated in FIG. 12. Once the enclosure 104 is removed from the support frame 102, the inner layer 160 and the outer layer 162 remain connected with each other so that the enclosure 104 is still one single part for convenient storage or washing.

It will be appreciated that the features and advantages described herein in relation to the dual-layer sidewall structure of the enclosure 104 may be provided for various embodiments of the infant playpen. For example, the features described herein in relation to the dual-layer sidewall structure of the enclosure 104 may be implemented separately or in combination with the expandable portions 150 according to the design requirements.

Advantages of the infant playpen described herein include an enclosure that has expandable portions covering pivot connections so that the infant playpen can be effectively folded and unfolded effortlessly. Moreover, the enclosure may have a dual-layer sidewall structure providing durability and allowing easy installation and removal of the enclosure.

Realization of the infant playpen has been described in the context of particular embodiments. These embodiments are meant to be illustrative and not limiting. Many variations, modifications, additions, and improvements are possible. These and other variations, modifications, additions, and improvements may fall within the scope of the disclosure as defined in the claims that follow.

What is claimed is:

1. An infant playpen comprising:

a support frame including two bars that are coupled to each other with a pivot connection; and an enclosure installable on the support frame, the enclosure comprising a flexible material including an expandable portion having a pleat that forms two folds, the two folds respectively including two folded edge portions, the expandable portion covering the pivot connection with the two folded edge portions wrapping at least partially around the same pivot connection when the enclosure is installed on the support frame;

wherein the two folds are folded toward each other over a base region of the flexible material of the enclosure, the two folded edge portions being adjacent to each other when the pivot connection is in an unfolded state and stretched away from each other so that more of the base region is exposed when the pivot connection is in a folded state, each of the two folded edge portions having at least one end affixed to the flexible material at a location adjacent to the pivot connection to hold the pleat in the unfolded state and the folded state.

2. The infant playpen according to claim 1, wherein the expandable portion includes an inverted box pleat.

3. The infant playpen according to claim 1, wherein the enclosure has a sidewall including an inner layer and an outer layer, the support frame extending through a hollow interior between the inner layer and the outer layer when the enclosure is installed on the support frame.

4. The infant playpen according to claim 3, wherein the enclosure includes an opening communicating with the hollow interior between the inner layer and the outer layer for facilitating installation and removal of the enclosure with respect to the support frame, the opening extending along at least one side of the enclosure.

5. The infant playpen according to claim 4, wherein the enclosure has a top and a bottom, the opening being disposed closer to the top than the bottom.

6. The infant playpen according to claim 4, wherein the enclosure includes a fastener operable to open and close the opening.

7. The infant playpen according to claim 6, wherein the fastener includes a zip fastener.

8. The infant playpen according to claim 1, wherein each of the two folded edge portions has at least one end affixed to the flexible material at a location adjacent to the pivot connection via a sewing line.

9. The infant playpen according to claim 1, wherein each of the two folded edge portions has two opposite ends affixed to the flexible material at a location adjacent to the pivot connection.

10. An infant playpen comprising:

a support frame including a plurality of upright legs, a top frame portion and a bottom frame portion; and an enclosure installable on the support frame and comprising a flexible material, the enclosure having a sidewall including an inner layer and an outer layer, the upright legs, the top frame portion and the bottom frame portion of the support frame extending in a hollow interior between the inner layer and the outer layer when the enclosure is installed on the support frame;

wherein the enclosure has an opening communicating with the hollow interior between the inner layer and the outer layer, and a fastener operable to open and close the opening, the support frame comprised of the upright legs, the top frame portion and the bottom frame portion being installable in the hollow interior between the inner layer and the outer layer through the opening.

11. The infant playpen according to claim 10, wherein the opening extends along at least one side of the enclosure.

12. The infant playpen according to claim 10, wherein the opening extends circumferentially around the enclosure.

13. The infant playpen according to claim 10, wherein the enclosure has a top and a bottom, the opening being disposed closer to the top than the bottom.

14. The infant playpen according to claim 10, wherein the fastener includes a zip fastener.

15. The infant playpen according to claim 10, wherein the support frame includes a pivot connection, and the enclosure includes an expandable portion having multiple folds, the expandable portion covering the pivot connection when the enclosure is installed on the support frame.

16. The infant playpen according to claim 15, wherein the folds wrap around the pivot connection when the enclosure is installed on the support frame.

17. The infant playpen according to claim 15, wherein the folds include two folded edge portions that are movable toward and away from each other.

18. The infant playpen according to claim 15, wherein the expandable portion includes an inverted box pleat.

* * * * *